US008066407B2

(12) United States Patent
Remus et al.

(10) Patent No.: US 8,066,407 B2
(45) Date of Patent: Nov. 29, 2011

(54) ELECTRONIC LUMINAIRE BASED ON LIGHT EMITTING DIODES

(75) Inventors: Rodrigo Ruizpalacios Remus, Queretaro (MX); Oscar Suarez Camacho, Queretaro (MX); Raul Escareño Romero, Queretaro (MX)

(73) Assignee: Servicios Condumex S.A. de C.V., Parque Industrial Jurica Queretaro QRO (MX)

( * ) Notice: Subject to any disclaimer, the term of this patent is extended or adjusted under 35 U.S.C. 154(b) by 439 days.

(21) Appl. No.: 12/290,528

(22) Filed: Nov. 1, 2008

(65) Prior Publication Data

US 2009/0303711 A1 Dec. 10, 2009

(51) Int. Cl.
*F21V 21/00* (2006.01)

(52) U.S. Cl. ..... 362/249.02; 362/147; 362/364; 362/404

(58) Field of Classification Search ..... 362/147, 362/148, 228, 229, 218, 217.1, 217.11, 217.12, 362/362, 364
See application file for complete search history.

(56) References Cited

U.S. PATENT DOCUMENTS

| | | | | |
|---|---|---|---|---|
| 4,749,061 | A * | 6/1988 | Orndorff et al. | 187/401 |
| 6,764,196 | B2 * | 7/2004 | Bailey | 362/147 |
| 6,871,983 | B2 * | 3/2005 | Jacob et al. | 362/364 |
| 7,686,479 | B2 * | 3/2010 | Yang et al. | 362/294 |
| 7,794,114 | B2 * | 9/2010 | Medendorp, Jr. | 362/294 |

* cited by examiner

*Primary Examiner* — John A Ward
(74) *Attorney, Agent, or Firm* — Carmen Pili Ekstrom

(57) ABSTRACT

An electronic luminaire based on light emitting diodes, for illumination with a low electric power consumption at indoor spaces for offices or wide spaces, which use false soffit systems on their ceilings, in order to adapt their lighting. It is based on a closed module that is manufactured with hot galvanized stamped laminated steel or with injection molding plastic, and comprehends four sections: A), B), C) and D), where A) corresponds to a casing which houses B) and C) overlapped sections, and these are finally assembled to D) section, together with an electronic power source; the B) section is an electrical harness, the C) section is a plurality of LED bars, and D) section corresponds to the reflecting screen, that counts with a plurality of individual reflecting elements of concave, elliptical or parabolic type.

20 Claims, 7 Drawing Sheets

A1)

B2)

C3)

D4)

ELECTRONIC LUMINAIRE BASED ON LIGHT EMITTING DIODES

BACKGROUND OF THE INVENTION

1. Field of the Invention

Electronic luminaries based on light emitting diodes (LEDs) with a power source which operates with alternating current and provides regulated direct current; they have a special design based on a dust protected and an enclosed four-section compact body that includes: an electric harness, multiple or individual bars with heat dissipation elements, plurality of LEDs and a reflecting multi-optics screen. The present LED luminaire has the characteristic of low power consumption, and is intended for indoor illumination in offices, laboratories, hallways, stairs and other wide open spaces like covered parking garages that preferably have grid ceiling systems in order to adapt an illumination system.

2. Description of the State of the Art

Different designs already exist with a luminosity provided by light emitting diodes (LEDs), for example in the U.S. Pat. No. 6,428,189 B1 there is a description of a lamp assembly which is electrically operated through light emitting diodes (LEDs) and comprehends a heat sink made of a metallic material arranged in series or in parallel connection related to a circuit panel. Its main characteristic is that it has spaces through and around which there is a plurality of LEDs; it also comprehends an integral heat sink belt in each LED that is placed in thermal contact with the heat sink in order to conduct the heat away from the LEDs on to the heat sink.

In the Mexican patent application MX/a/2007/011521, filed in by this same Petitioner, there is a lamp description with a technology based on light emitting diodes (LEDs) and provides lighting for indoor applications in an efficient and economical way, with a longer life span than conventional technologies, which represents up to 5 times more in useful life, with a low energy consumption. These are ideal for use in places where a continuous operation is required. Each lamp has a power consumption of 48 watts, and each one is distinguished by a metallic aluminum plate or substrate, the main function of which is to transport the heat away from the LEDs and also to support the lamp structure; the substrate has a plurality of holes in which the elements for the light emitting diodes are placed on the top side of the substrate. The assembly is protected by a PET polymer diffuser.

The luminaire that constitutes the present invention is based on LEDs with high luminous flux output, and has an optimized distribution for indoor applications, with the characteristic of low power consumption. The luminaire is composed by a base or main casing preferably manufactured by injection molding of plastic, together with metallic elements for heat dissipation in multiple bars or in individual elements for each (LED).

The casing is a sole body unit, and it can be manufactured by sheet metal stamping of laminated steel, galvanized type, or laminated aluminum.

DESCRIPTION OF THE INVENTION

Figure 1:
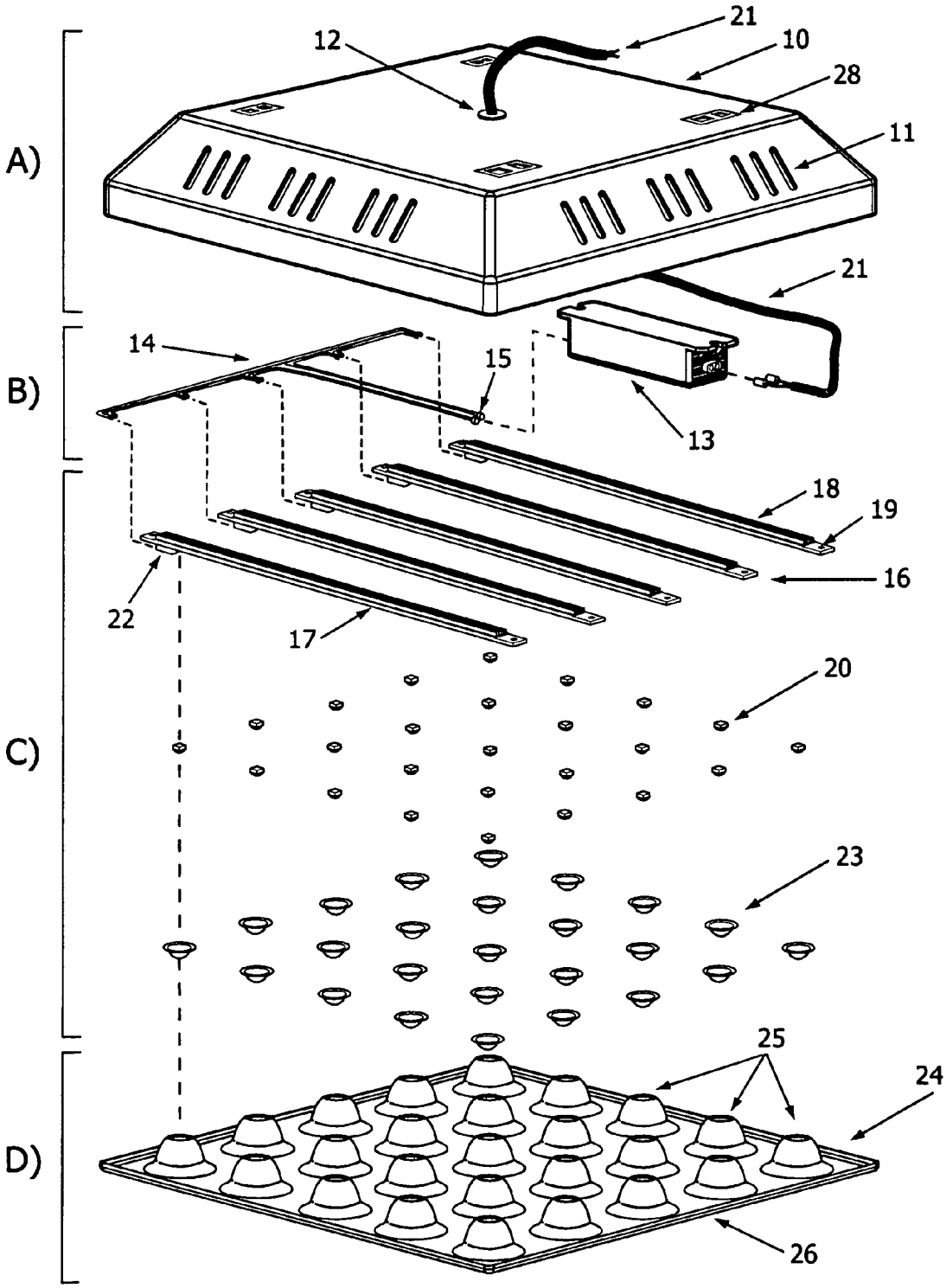

The following section describes the invention according to the drawings in the FIGS. 1 to 7, where:

FIG. 1 Corresponds to an exploded isometric view of the luminaire, with its A, B, C and D sections showing LED bars and multiple heat sinks.

Figure 2:
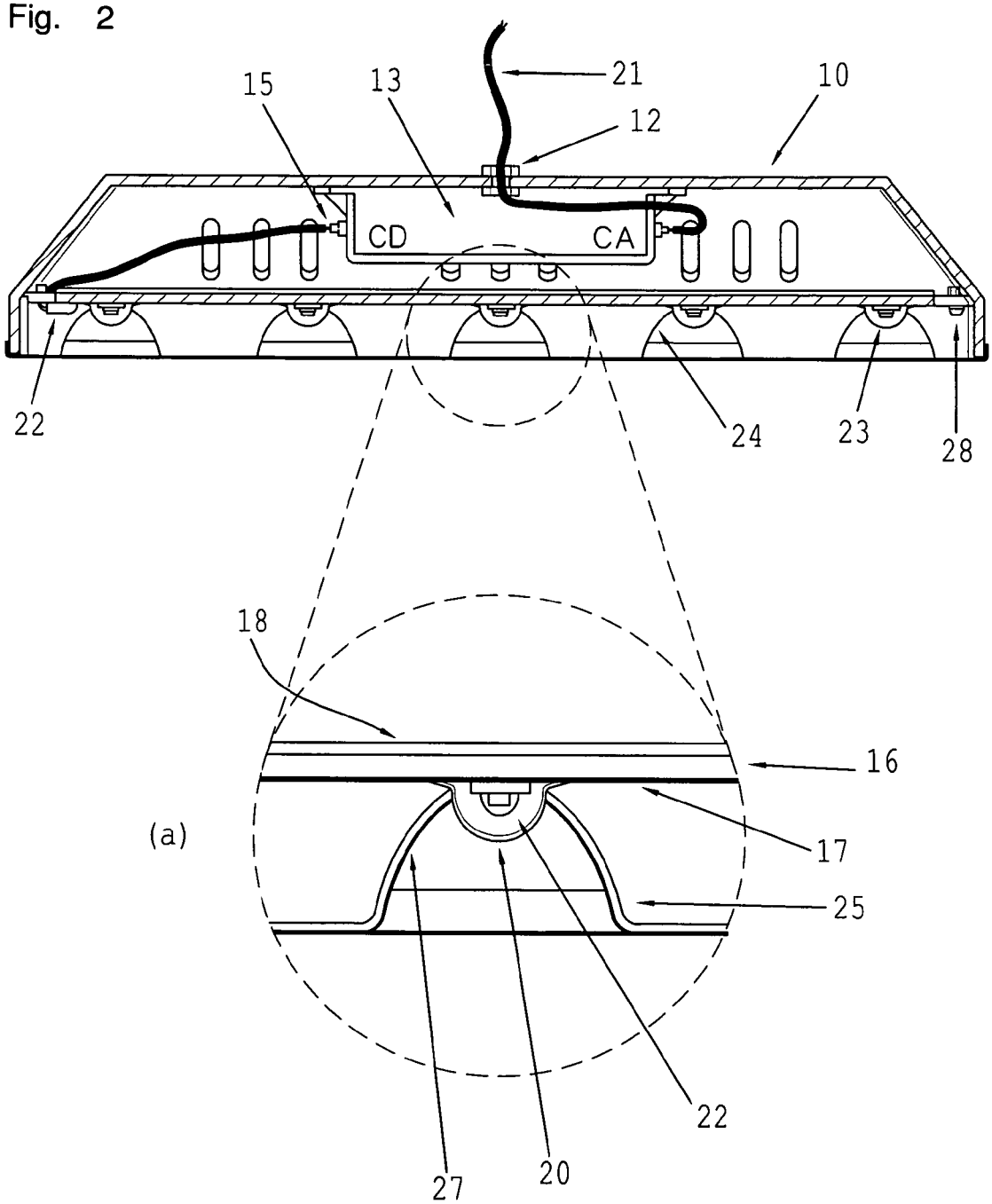

FIG. 2 Corresponds to a side view of the A section in the luminaire from FIG. 1, showing an a) detail of the screen.

Figure 3:
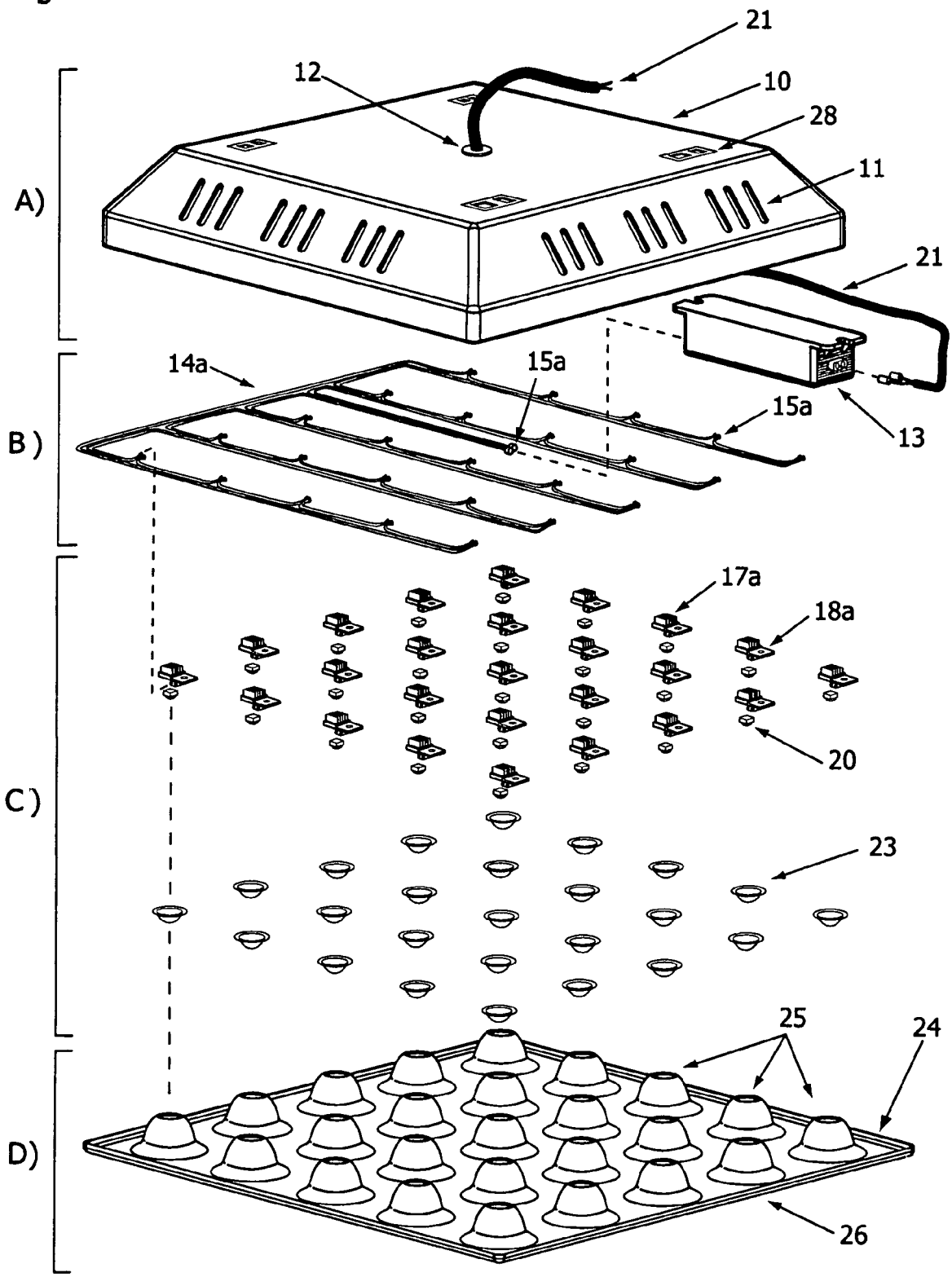

FIG. 3 Corresponds to an exploded view of the sections A, B, C, and D of the luminaire with LEDs and individual heat sinks.

Figure 4:
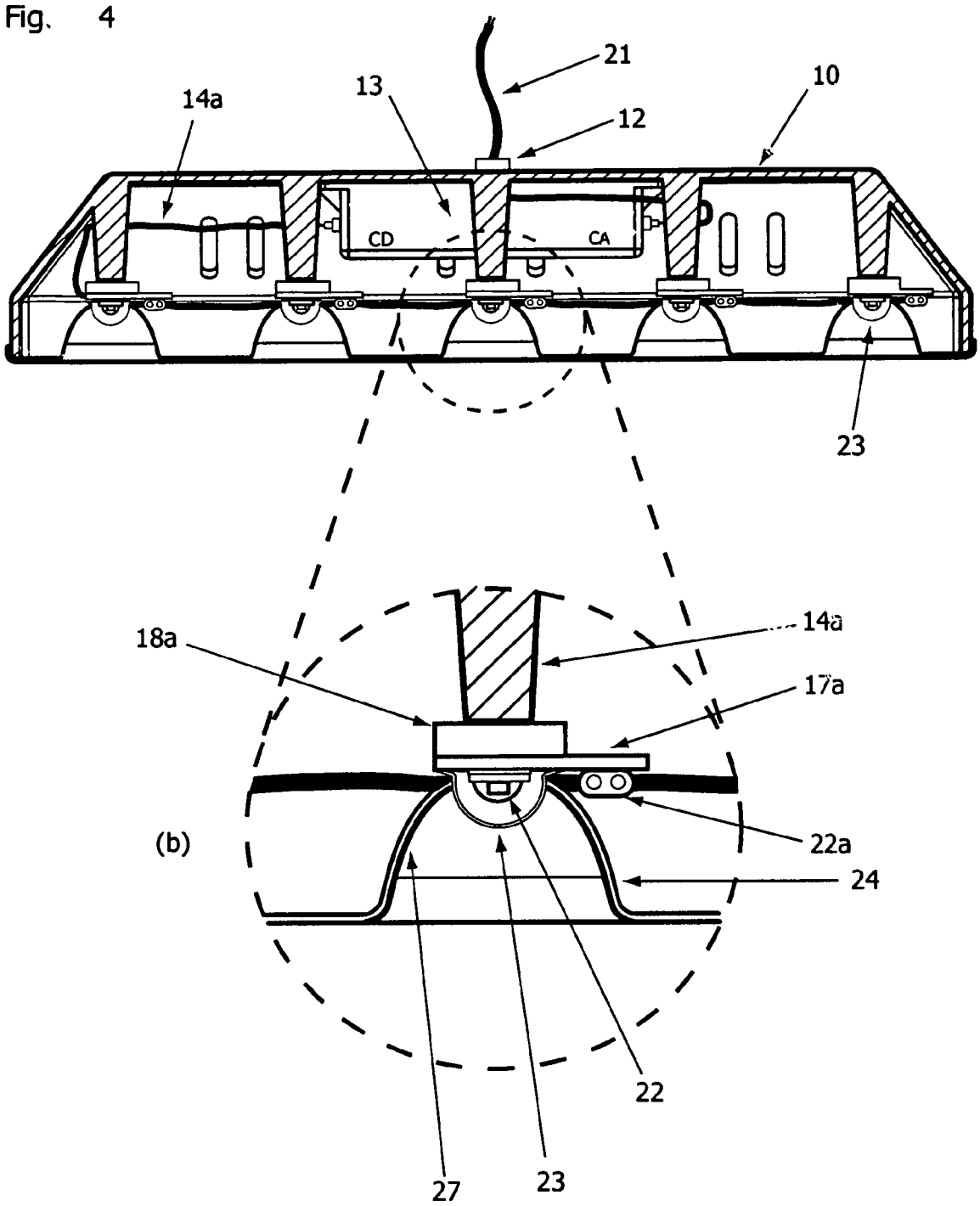

FIG. 4 Corresponds to a sectioned side view of the luminaire shown in FIG. 3, with the detail (b) of the screen.

Figure 5:
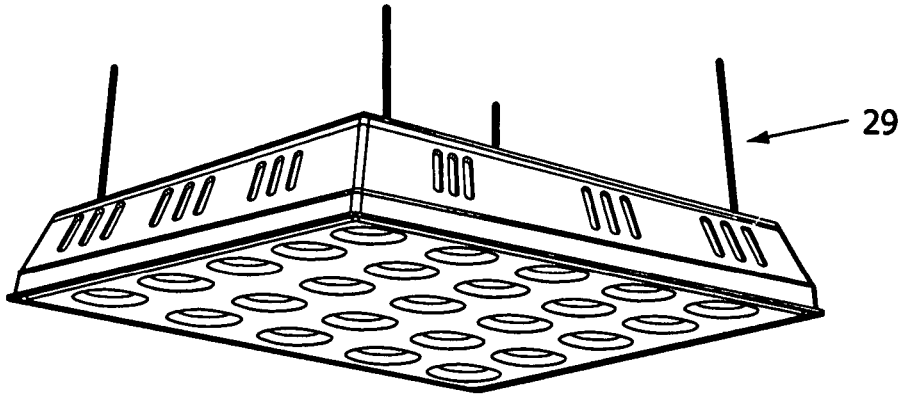
Figure 5:
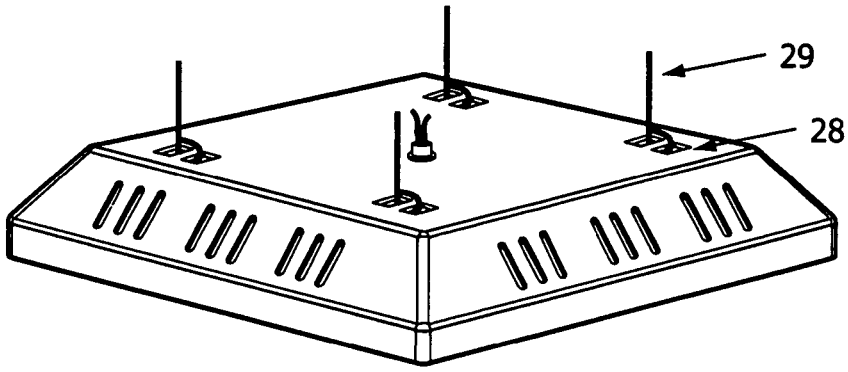
Figure 5:
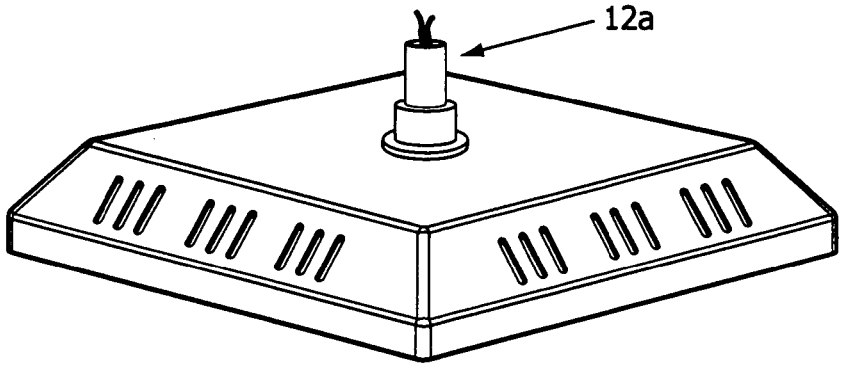
Figure 5:
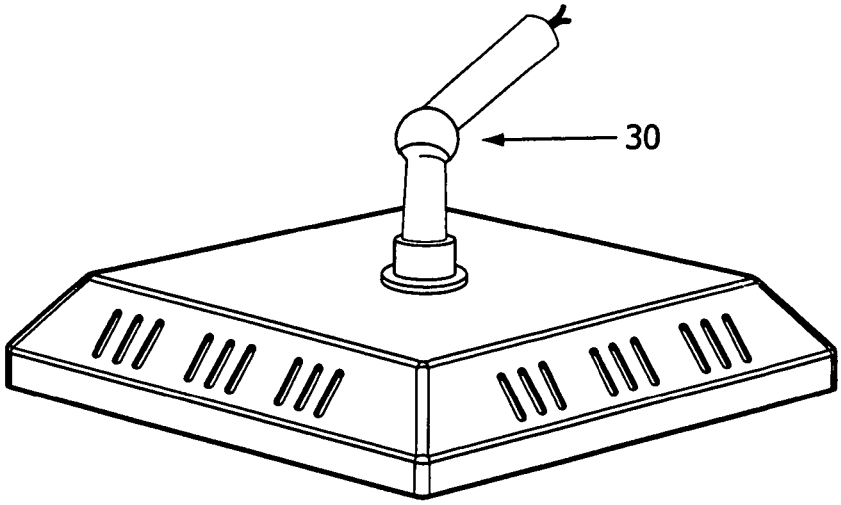

FIG. 5 Corresponds to several views of the luminaire for different installation methods, where ($A_1$) and ($B_2$) views correspond to suspended fastening, ($C_3$) for centered hanging fastening using conduit tube and ($D_4$) for fastening with a centered joint for various positions.

Figure 6:
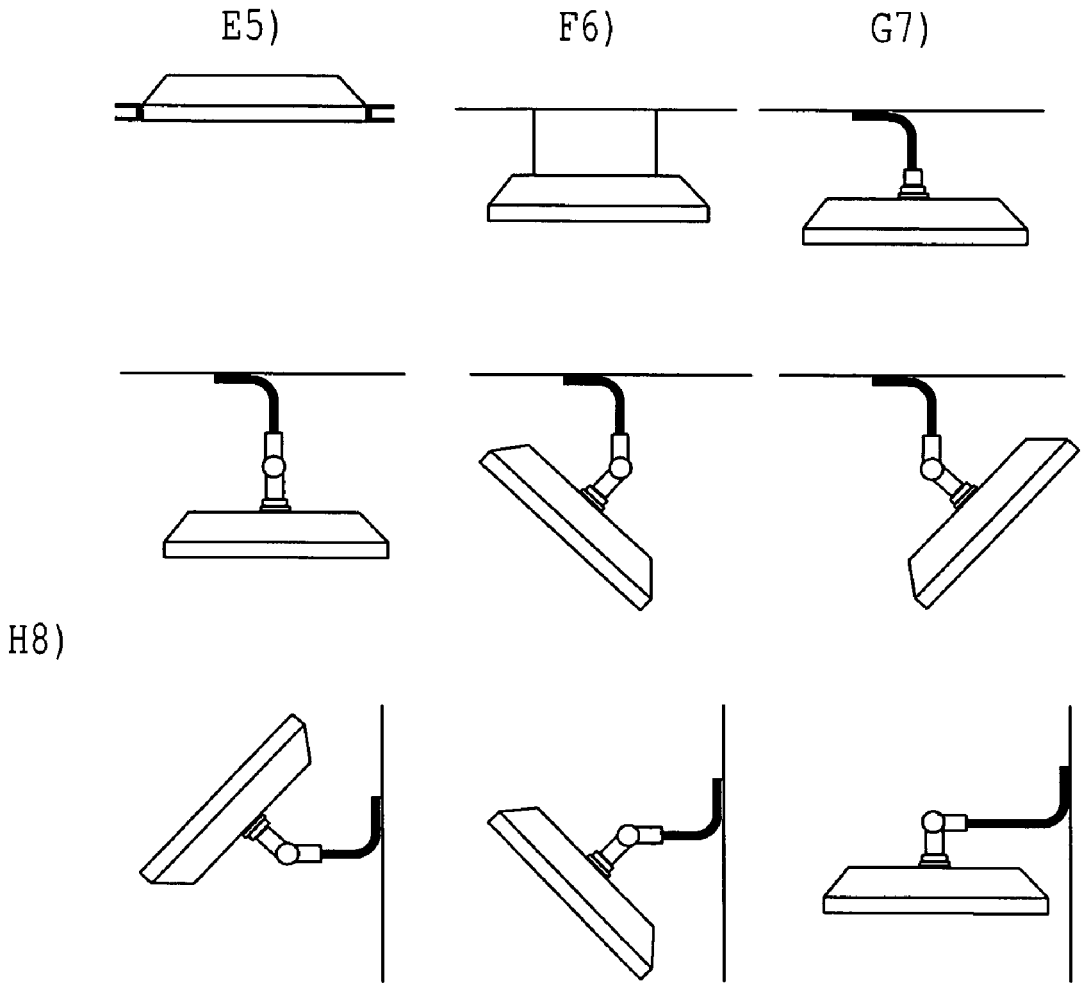

FIG. 6 Corresponds to different views of FIG. 5, where ($F_6$) is for suspended fastening, ($G_7$) for centered suspended fastening, ($H_8$) for fastening by centered articulation in several positions, and ($E_5$) for recessed installation in grid-type ceiling systems.

Figure 7:
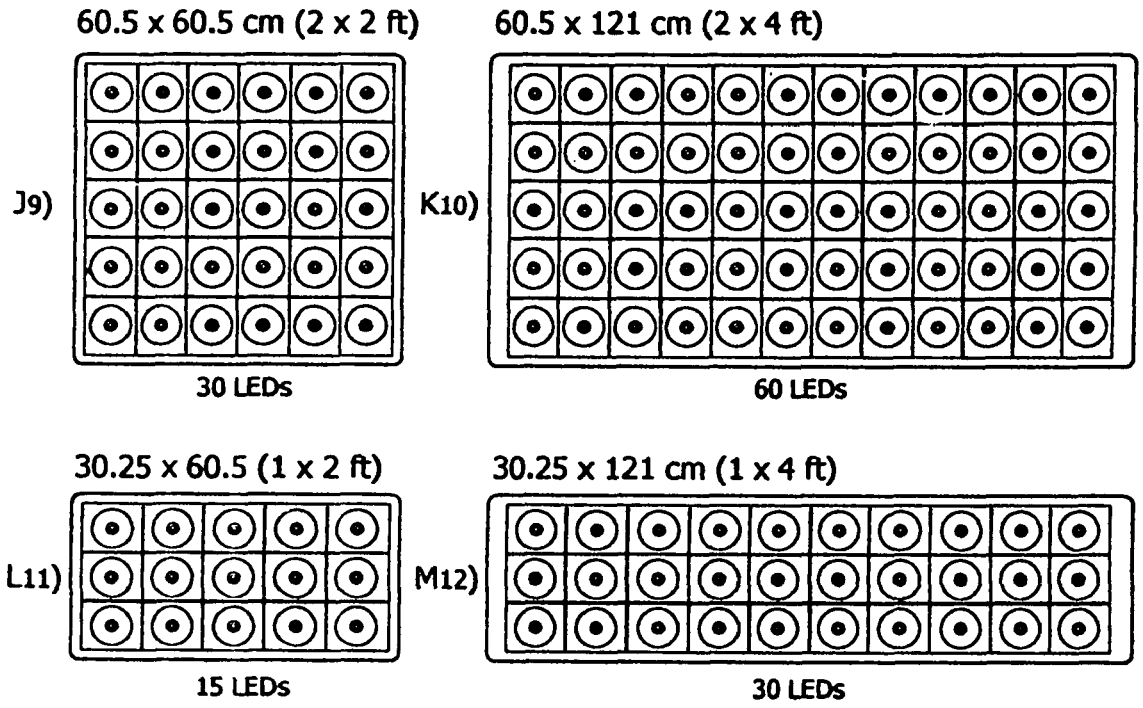

FIG. 7 Corresponds to a view from the lower external base of the luminaire with different reflecting screens: ($J_9$), ($K_{10}$), ($L_{11}$) and ($M_{12}$) for diverse LEDs and dimension configurations.

The invention is related to a luminaire 10 FIG. 1 to FIG. 4, based on a square or rectangular module, or other design, consisting of a single compact and closed unit, distinguished by a module which is comprised by four sections: (A), (B), (C) and (D); these are coupled and assembled together, where (B) and (C) sections are placed within (A), and (D) is assembled over the (A) section in the luminaire module, with such a module being formed by the following elements: a casing device, which corresponds to the (A) section, preferably made of injection molded plastic; it can also be manufactured by stamping and bending processes, of sheet metal such as galvanized rolled steel or rolled aluminum, with a plurality of vents: 11 FIG. 1, arranged on its side faces or on the top cover, if required; it also has an exit with a plastic ring: 12, or a tubular ring: 12*a*, FIG. 5 ($C_3$), with an electrical connector wired to the center or to the side of the top cover, for external electrical connections: 21, to the general power feeding line for the plurality of luminaries, which also acts as an input to the power supply: 13, for direct current feeding to the plurality of LEDs; next, the (B) section of the electric harness: 14, is placed inside the casing; such harness allows to manipulate the assembly and LEDs connections; the harness has a male electrical connecting element: 15, which is wired to the (+) (−) poles on the power supply 13; then the overlapped (C) section—formed by a plurality of at least two or more double-faced PCB or MCPCB type bars: 16, and a printed circuit board with a metal core; such bars are equidistantly placed between in a parallel position inside the (A) section of the module. These bars: 16, are integrated by a printed circuit board: 17, and a heat dissipating metal element: 18 made of aluminum, detail (a), FIG. 1, FIG. 2, and overlapped one against the other; they have holes: 19, on each of the bar ends for its fastening to module: 10 of the casing—(A) section. The MCPCB bar is printed circuit board assembly, which is built with two overlapping copper layers, separated by a dielectric isolator, or only one copper layer with dielectric isolator, and a final metal layer—typically aluminum—; such card is fastened to the heat dissipating element with a special high thermal conductivity adhesive. The configuration of the double sided PCB bar is similar to the MCPCB bar, except for the absence of the external metal layer. For both types of electronic cards there is a two-pole (+) (−) female connector: 22, FIG. 2, which is connected to the harness: 14, by multiple two-pole male connectors 15*a*. The multiple LEDs: 20, FIG. 1, are distributed equidistantly to each other along the bars, and their amount varies according to the dimensions of the available surface area on the selected modules over the casing; the number of LEDs can vary from 1 to 25 or more, depending on the user's lighting needs; in this ceiling systems with standard dimensions such as: 60×60 cm, 30×60 cm, 30×120 cm, or 60×120 cm. The LEDs: 20, also have protecting elements to shelter them from dust, insects and moisture; such guards; 23, are concave or semispherical type, allowing the separation of the (D) section without damaging the LED. Next, section (D) corresponds to the reflecting screen: 24. This section has the same geometrical perimeter as the casing does, and it is assembled to the casing by hand pressure or using metal pieces (with screws); it can contain multiple reflectors: 25, with parabolic or elliptical type, or any other concave geometry which benefits light distribution; in this case, there is a series from 10 to 60: FIG. 7, placed equidistantly on each row, with a total from 10 to 40 or more reflecting screens; these are manufactured with ABS or PC plastic sheet, by processes like thermoforming or injection molding, with a surface finish deposit of high brightness chrome 27, FIG. 2, detail a), or by mechanical methods like stamping of high brightness aluminum.

On (D) section a flange 26 is shown on its perimeter, in order to simplify coupling to the casing.

The luminaire has an additional configuration, according to FIG. 3, (C') section, where the LEDs 20, are not placed on bar elements: 16, FIG. 1 with multiple LEDs, but as individual LED sub-assemblies 20 (C') section of FIG. 3. In this case, the original harness 14, FIG. 1, is modified, with the harness 14*a*, of the (B') section showing a plurality of connectors 15*a*, corresponding to each LED 20, while the original bars and heat sinks of FIG. 1 are eliminated as multiple elements, and are adapted as individual heat sink elements 18*a*, and electronic board 17*a* FIG. 3. The rest of the components in FIG. 1 included in the casing (A) section and reflecting screen 24 from section (D), do not change from their original design.

ADVANTAGES OF THE INVENTION

The luminaire which is described in this invention offers the following advantages, compared to the existing lighting systems for indoor environments, based on fluorescent tubes:

- It is a luminaire product with low power consumption.
- It contributes with a minimum thermal load to a building's cooling system, because it operates at temperatures below 55° C.
- It is a luminaire which requires a minimum maintenance and has a higher useful rated (50,000 hr.), compared to a fluorescent tube (1,200 hr. to 20,000 hr.).
- Its power supply has automatic power factor correction, which is relevant in lighting installations where the negative contribution of the power factor, caused by the inductive charges from the luminaire ballasts for fluorescent tube, can provoke a penalty from the power supplier.
- It is a compact and completely closed luminaire product, which reduces dust accumulation.
- The cooling of the electronic components is achieved by natural convection.
- It eliminates problems related with dazzling.
- Its manufacturing method allows creating a wide range of shapes and sizes.
- It combines an ultra-light weight with a good stiffness for its handling and installation.
- The reflector's shape and surface finish contribute to the concentration of the light emitted by the LEDs.
- It facilitates the interchangeability of the components for its maintenance after the installation.
- It can be manufactured in an individual version or in multiple position arrangements.

There are three different types of installation positions of the luminaries, according to FIG. 5 and FIG. 6. The ($E_5$) luminaire is shown with a classic recessed installation in a standard suspended grid ceiling 2×2 ft (60×60 cm) 15, overlapping by hand pressure on the frames of the ceiling system.

The ($A_1$) and ($B_2$) luminaries demonstrate a suspended version with wire fastening 29 at four points 28 FIG. 5 ($B_2$).

The ($C_3$) luminaire shows a suspended version with centered fastening and a direct connection through a conduit tube. This version can be adapted for mounting on a wall, using a knee joint mechanism for an adjustable inclination.

There are different versions of the luminaire as shown in FIG. 6: ($E_5$) corresponds to a recessed on a suspended ceiling system version; while ($F_6$) for fastening by a centered hanging; ($G_7$) for fastening with conduit tube, and ($H_8$) for fixing by a centered knee joint with several positions.

On FIG. 7 several luminaries are shown, which can be formed by 15, 30, 60 or more reflecting elements 25, FIG. 1 (D), according to the user's illumination distribution and intensity requirements. See FIG. 7: ($J_9$), ($K_{10}$), ($L_{11}$) and ($M_{12}$).

Based on the previous description, the invention is considered a novelty, and therefore the following claims are made for its content.

The invention claimed is:

1. An electronic luminaire based on light emitting diodes (LEDs) for illumination with low electric power consumption in indoor environments, the luminaire comprising:

a module having a variable geometrical design, comprising:

a first horizontal member comprising a casing section (A) having an upper and lower surface; the upper surface comprising: a) a centered exit hole fitting which is used for external exit of connecting cables and electrical connecting elements, and on its internal part is a lodge for an electric power source for direct current feeding of a plurality of LEDs; b) a plurality of vents on the side or top faces of the casing: and c) a plurality of points on the corners of the casing for a plurality of wire fastening elements;

a second horizontal member comprising an electrical harness section (B) which is fastened to the casing of section (A) which facilitates the LED assembly; section (B) is overlapped and fastened to section (C); the electric harness, comprising a plurality of spaced connectors for a plurality of printed circuit board (PCB); and situated midway of the electric harness is an extended electrical connecting element to the power source; said electric harness on a perpendicular axis to the PCB and electrical connecting element;

a third horizontal member section (C) comprising: a) a plurality of parallel, spaced apart longitudinal printed circuit board (PCB) panel connected to the electric harness at a first end; b) mounted on the PCBs is a plurality of heat dissipating elements/heat sink elements on a plurality of longitudinal strips of metal core printed circuit board (MCPCB) or printed circuit board type bars with holes at a second end; c) a plurality of LED acceptor assembly to which the LEDs are attached; said LEDs distributed equidistantly to each other along the bars; and d) a plurality of protecting element guards;

a fourth horizontal member section (D) coupled to section (C) comprising: a) a reflecting screen; b) a plurality of reflecting elements; and c) a flange.

2. The electronic luminaire of claim 1 which is used in offices, laboratories, hallways or wide spaces which use false soffit systems on their ceilings.

3. The electronic luminaire of claim 1 which is a closed module, manufactured with stamped laminated hot-galvanized steel, aluminum or injection molding plastic.

4. The electronic luminaire of claim 1, wherein section (C) formed by multiple type metal core printed circuit board (MCPCB) bars, a printed circuit panel with metal core or a double faced PCB type like printed circuit panel.

5. The electronic luminaire of claim 4, wherein the MPCB comprises two overlapping copper layers separated by either dielectric isolator or only one copper layer with dielectric isolator and a final aluminum metal layer while PCB comprises overlapping copper layers separated by either a dielectric isolator or only one copper layer with dielectric isolator.

6. The electronic luminaire of claim 1, wherein section (D) is fastened to section (A) by hand pressure or by fastening elements.

7. The electronic luminaire of claim 1, wherein section (D) contains a plurality of reflecting elements with parabolic, elliptic or concave type which facilitates and reflects light distribution.

8. The electronic luminaire of claim 1 wherein section (A) is a pyramidal, square or rectangular body casing has a flange around the perimeter of its lower base for a better assembly with the reflecting screen; wherein said exit hole fitting is selected from a plastic ring, tubular ring or elongated tubular ring with a circular ring joint.

9. The electronic luminaire of claim 8, wherein the casing of section (A) is assembled together with false soffits, optionally hanged individually or containing a knee joint mechanism, so that it can be moved to different angle positions.

10. The electronic luminaire of claim 1, wherein the electronic power source operates with alternating current and provides a regulated direct current.

11. The electronic luminaire of claim 1, wherein the LED acceptor assembly of section (C) is LED bars that are equidistantly arranged between them in a parallel way, and each of the bars is respectively integrated by one electronic card element and one metallic aluminum element which dissipates the heat by natural convection of the LEDs, and wherein the elements are overlapped and fixed with an adhesive.

12. The electronic luminaire of claim 11, wherein its electronic card has a two-pole (+) (−) connector.

13. The electronic luminaire of claim 1, wherein the LED acceptor assembly of section (C) is a bar and the LEDs are equidistantly distributed along the bar, one next to the other, and their number varies according to the available surface area on the casing.

14. The electronic luminaire of claim 13 which comprises N LED combinations, in P arrangements, and in Q columns, where N=P×Q, to be optionally coupled to soffit systems with dimensions selected from among 60×60 cm, 30×60 cm, 60×120 cm, and 30×120 cm.

15. The electronic luminaire of claim 14, wherein the number of LEDs is selected from 1 to 40, 8, 10, 15, 16, 20, 25, 32, 40 or 60 LEDs.

16. The electronic luminaire of claim 1, wherein the LEDs have protecting elements against dust, insects, moisture and handling, and the protecting elements are concave or semi-spherical type, allowing the separation of section (D) without damaging the LED.

17. The electronic luminaire of claim 1, wherein the section (D) reflecting screen is assembled to the casing of section (A) using hand pressure or by mechanical ways using screws, and section (D) contains rows of individual reflectors with dimensions selected from among 2×4, 2×5, 2×8, 3×5, 3×10, 4×4, 4×5, 5×5, 5×6, 8×5, and 5×12.

18. The electronic luminaire of claim 17, wherein the reflecting screen is shaped with ABS or PC film, by the use of thermoforming process or injection molding, with a final coating made of high bright chrome, or by stamping or embedding processes using high bright aluminum.

19. An electronic luminaire based on light emitting diodes, for illumination using low electric energy consumption in indoor spaces, the luminaire comprising a module having a variable geometrical design, comprising;

a first horizontal member comprising a casing section (A) having an upper and lower surface; the upper surface comprising; a) a centred exit hole fitting which is use for external exit of connecting cables and electrical connecting elements, and on its internal part is a lodge for an electric power source for direct current feeding of a plurality of LEDs; b) a plurality of vents on the side or top faces of the casing; and c) a plurality of points on the corners of the casing for a plurality of wire fastening elements;

a second horizontal member comprising an electrical harness section (B) which is fastened to the casing of section (A) which facilitates the LED assembly; section (B) is overlapped and fastened to section (C); said electric harness, comprising a plurality of spaced connectors for a plurality of parallel, spaced apart longitudinal printed circuit board (PCB); and situated midway of the electric harness is an extended longitudinal electrical connecting element to the power source; said electric harness on a perpendicular axis to the PCB and electrical connecting element;

a third horizontal member section (C) comprising: a) a plurality of parallel, spaced apart longitudinal printed circuit board (PCB) panel connected to the electric harness at a first end; b) mounted on the PCBs is a plurality of heat dissipating elements/heat sink elements on a plurality of longitudinal strips of metal core printed circuit board (MCPCB) or primed circuit board type bars with holes at a second end; c) a plurality of LED acceptor assembly to which the LEDs are attached, said LEDs distributed equidistantly to each other along the bars; and d) a plurality of protecting element guards;

a fourth horizontal member section (D) coupled to section (C) comprising: a) a reflecting screen; b) a plurality of reflecting elements: and c) a flange, wherein the LEDs are connected to an electrical harness in section (B) for each set of LEDs such that the LEDs are put like individual parts in section (C), together with their own electronic card element, and a heat dissipating element that works by natural convection and they are connected to a section (B) harness which has an individual connector for each LED; and section (D) is a reflecting screen that is coupled to section (A).

20. The electronic The electronic luminaire of claim 1 wherein the LEDs are not placed on bar elements with multiple LEDS but as an individual IAD subassembly; and the heat sinks are eliminated as multiple elements and adapted as individual heat sink elements and electronic board.

* * * * *